US008285158B2

(12) United States Patent
Aiko

(10) Patent No.: US 8,285,158 B2
(45) Date of Patent: Oct. 9, 2012

(54) IMAGE FORMING APPARATUS AND CONTROL METHOD THEREFOR

(75) Inventor: Yasuyuki Aiko, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/616,602

(22) Filed: Nov. 11, 2009

(65) Prior Publication Data

US 2010/0124425 A1 May 20, 2010

(30) Foreign Application Priority Data

Nov. 14, 2008 (JP) ..... 2008-292164

(51) Int. Cl.
*G03G 15/00* (2006.01)

(52) U.S. Cl. ..... 399/37; 399/33; 399/67; 399/88

(58) Field of Classification Search ..... 399/8, 33, 399/37, 38, 67, 75, 88, 320
See application file for complete search history.

(56) References Cited

U.S. PATENT DOCUMENTS

| | | | | |
|---|---|---|---|---|
| 2005/0058467 | A1* | 3/2005 | Sasamoto et al. | 399/67 |
| 2006/0018678 | A1* | 1/2006 | Sekiguchi et al. | 399/70 |
| 2007/0071479 | A1* | 3/2007 | Semma et al. | 399/88 |
| 2007/0280720 | A1* | 12/2007 | Kimura | 399/88 |

FOREIGN PATENT DOCUMENTS

| | | | |
|---|---|---|---|
| JP | 2004-226888 | A | 8/2004 |
| JP | 2007-102008 | A | 4/2007 |

* cited by examiner

*Primary Examiner* — Walter L Lindsay, Jr.
*Assistant Examiner* — Benjamin Schmitt
(74) *Attorney, Agent, or Firm* — Rossi, Kimms & McDowell LLP

(57) ABSTRACT

An image forming apparatus that is capable of preventing an abnormal operation due to a voltage drop of a commercial power source and continuing an image forming operation efficiently even if the voltage drop occurs. A fixing unit fixes a toner image transferred onto a sheet. A voltage detection unit detects an input voltage of the commercial power source. A setting unit sets a fixing electric power supplied to the fixing unit from the commercial power source. A control unit suspends an operation when the set fixing electric power is less than a predetermined electric power and when the input voltage is less than a first voltage, and to continue the operation while reducing the set fixing electric power when the set fixing electric power is not less than the predetermined electric power and when the input voltage is less than a second voltage.

10 Claims, 7 Drawing Sheets

IMAGE FORMING APPARATUS AND CONTROL METHOD THEREFOR

BACKGROUND OF THE INVENTION

1. Field of the Invention

The present invention relates to an electro-photographic image forming apparatus such as a copier, a electrostatic printer, and a facsimile, and relates to a control method therefor.

2. Description of the Related Art

Generally, an image forming apparatus using an electrophotography process has a heating-type fixing device. This kind of image forming apparatus develops an electrostatic latent image formed on a photosensitive member by photoirradiation with developing material (toner) to form a toner image, transfers the toner image onto a recording medium such as a recording paper, and then, fixes the toner image thermally on a recording paper by the fixing device.

The fixing device is provided with a heating roller that is made by forming a resin coating on a surface of a cylindrical metal core, and a pressure roller having an elastic layer on a surface thereof that comes into contact with the heating roller while giving pressure thereto. A fixing process is performed under a condition where a surface temperature of the heating roller has reached to a predetermined fixing temperature. That is, a recording paper that bears a not-yet-fixed toner image is passed through a nip position between the heating roller and the pressure roller so that a toner-image side comes into contact with the heating roller. As a result, the toner image is fused and fixed to the recording paper by heat and pressure.

When the image forming apparatus starts after turning a power on, a predetermined electric power is applied to the heating roller to increase a temperature, while being monitored by a thermistor etc. so as to reach a fixing temperature of around 200° C. within a predetermined time. In order to compensate a quantity of heat taken away by the passing recording paper during an image formation of the image forming apparatus and to maintain the fixing temperature, an electric power corresponding to a difference between the temperature of the heating roller and a target temperature has to be applied. Since the temperature of the pressure roller that faces to the heating roller does not reach the fixing temperature immediately after starting the image formation, an electric power that is larger than the electric power corresponding to the quantity of heat taken away by the recording paper has to be applied. A required electric power is gradually reduced as the temperature in the fixing device including the above-mentioned pressure roller etc. increases to approach the fixing temperature due to continuation of a subsequent operation.

Thus, the fixing device needs a maximum fixing electric power when starting up after turning the power on and when starting the image formation immediately after that. In this case, since the image taming apparatus obtains the electric power from a general commercial power source via an electric power cable from a house wiring or an output port of the commercial power source (referred to as a plug socket, hereinafter) to the image forming apparatus, impedance of the electric power cable reduces a power source voltage at a power source input unit of the image forming apparatus correspondingly. When used in Japan, if a voltage falls 15% or more in general with respect to a nominal 100V input, the apparatus tends to generate malfunction etc. Therefore, Japanese laid-open patent publication (Kokai) No. 2004-226888 (JP2004-226888A) discloses a method to reduce an electric power consumption of an image forming apparatus by reducing a speed of an image formation process in proportion to a voltage drop. Moreover, Japanese laid-open patent publication (Kokai) No. 2007-102008 (JP2007-102008A) discloses a method to reduce a voltage drop by mainly controlling a fixing electric power within a range between upper and lower limits.

However, the voltage of the commercial power source fluctuates due to an external environment such as an area in which the image forming apparatus is installed and a house wiring. Moreover, the voltage of the commercial power source fluctuates due to an external factor such as an operating condition where a plug socket is shared with another device whose electric power consumption is large. That is, even when an electric power consumption of the image forming apparatus is very small, for example, when an electric power switch is OFF, the voltage of the commercial power source might have already dropped close to a lower limit voltage.

FIGS. 6A and 6B are graphs showing relations between the electric power consumption of the image forming apparatus and an input voltage of the commercial power source. FIG. 7 is a graph showing a relation among the electric power consumption of the image forming apparatus, the input voltage of the commercial power source, and a fixing unit temperature.

As shown in FIG. 6A, when the electric power consumption P of the image forming apparatus is a very small value less than a minimum electric power P2, the voltage drop amount of the input voltage Vac is very small with respect to a normal voltage V1(=100V). Then, if the input voltage Vac does not drop to a guaranteed operation voltage V2 (=85V) that can guarantee an operation, even when the electric power consumption P increases to a maximum electric power P1, the apparatus can operate normally.

However, as shown in FIG. 6B, if the input voltage Vac drops close to 85V due to the external factor even when the electric power consumption P is very small (601), there is a fear that the input voltage Vac becomes lower than the guaranteed operation voltage 85V as the electric power consumption P increases due to an application of the fixing electric power etc. afterward.

Accordingly, even if a user tries to operate the image forming apparatus from a minimum fixing electric power that can secure a fixing function under the above-mentioned condition like Japanese laid-open patent publication (Kokai) No. 2007-102008 (JP2007-102008A), the following problems arise. That is, since the electric power consumption of the image forming apparatus causes the voltage drop, there is a fear to cause an abnormal operation of the image forming apparatus or another device that shares the plug socket.

Even when the voltage drop is detected during the image formation, the voltage drop due to the external factor cannot be resolved by lowering the fixing electric power to the minimum fixing electric power. Therefore, when continuing a print operation, i.e., when continuing an application of the fixing electric power, there is a fear to cause the abnormal operation of the image forming apparatus or another device that shares the plug socket.

On the other hand, when a factor of the image forming apparatus causes the voltage drop that can be resolved by lowering the fixing electric power, the following matters can be shown. That is, when the electric power consumption P increases to the maximum electric power P1 as shown in a section 603 in FIG. 7, the input voltage drops to the guaranteed operation voltage V2 (=85V), which results in the abnormal operation. However, if the electric power consumption P is lowered as shown in sections 604 and 605, a margin of the input voltage Vac with respect to the guaranteed operation voltage V2 (=85V) increases. Therefore, if the electric power consumption P is controlled so as not to exceed a limit electric power P3 smaller than the maximum electric power P1 at the maximum for example, the operation can be continued.

Although a fixing unit temperature Tfix becomes lower than a target temperature (=T1) because of a reduction of the maximum electric power, it is unnecessary to lower a paper conveying speed when the fixing unit temperature Tfix is higher than a lower limit temperature T2 at which the fixing function can be ensured.

On the other hand, since the method to reduce the electric power consumption by lowering a print speed in proportion to the voltage drop as shown in Japanese laid-open patent publication (Kokai) No. 2004-226888 (JP2004-226888A) immediately reduces a number of sheets processed by the image formation, it brings a user a disadvantage.

SUMMARY OF THE INVENTION

The present invention provides an image forming apparatus and a control method therefor that are capable of preventing an abnormal operation due to a voltage drop of a commercial power source and continuing an image forming operation efficiently even if the voltage drop occurs.

Accordingly, a first aspect of the present invention provides an image forming apparatus that operates by an electric power supplied from a commercial power source, comprising a fixing unit adapted to fix a toner image transferred onto a sheet, a voltage detection unit adapted to detect an input voltage of the commercial power source, a setting unit adapted to set a fixing electric power supplied to the fixing unit from the commercial power source, and a control unit adapted to suspend an operation of the image forming apparatus when the set fixing electric power is less than a predetermined electric power and when the input voltage detected by the voltage detection unit is less than a first voltage, and to continue the operation of the image forming apparatus while reducing the set fixing electric power when the set fixing electric power is not less than the predetermined electric power and when the input voltage detected by the voltage detection unit is less than a second voltage.

Accordingly, a second aspect of the present invention provides a control method for an image forming apparatus that is provided with a fixing unit to fix a toner image transferred onto a sheet by an electric power supplied from a commercial power source, a voltage detection unit to detect an input voltage of the commercial power source, a setting unit to set a fixing electric power supplied to the fixing unit, the control method comprising suspending an operation of the image forming apparatus when the set fixing electric power is less than a predetermined electric power and when the input voltage detected by the voltage detection unit is less than a first voltage, and continuing the operation of the image forming apparatus while reducing the set fixing electric power when the set fixing electric power is not less than a predetermined electric power and when the input voltage detected by the voltage detection unit is less than a second voltage.

Accordingly, a third aspect of the present invention provides an image forming apparatus that operates by an electric power supplied from a commercial power source, comprising a predetermined load whose electric power consumption can be changed, a voltage detection unit adapted to detect an input voltage of the commercial power source, a setting unit adapted to set an electric power supplied to the predetermined load from the commercial power source, and a control unit adapted to suspend an operation of the image forming apparatus when the electric power set by the setting unit is less than a predetermined electric power and when the input voltage detected by the voltage detection unit is less than a first voltage, and to continue the operation of the image forming apparatus while reducing the electric power set by the setting unit when the electric power set by the setting unit is not less than the predetermined electric power and when the input voltage detected by the voltage detection unit is less than a second voltage.

According to the present invention, the abnormal operation due to the voltage drop of the commercial power source can be prevented and the image forming operation can be efficiently continued even if the voltage drop occurs.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
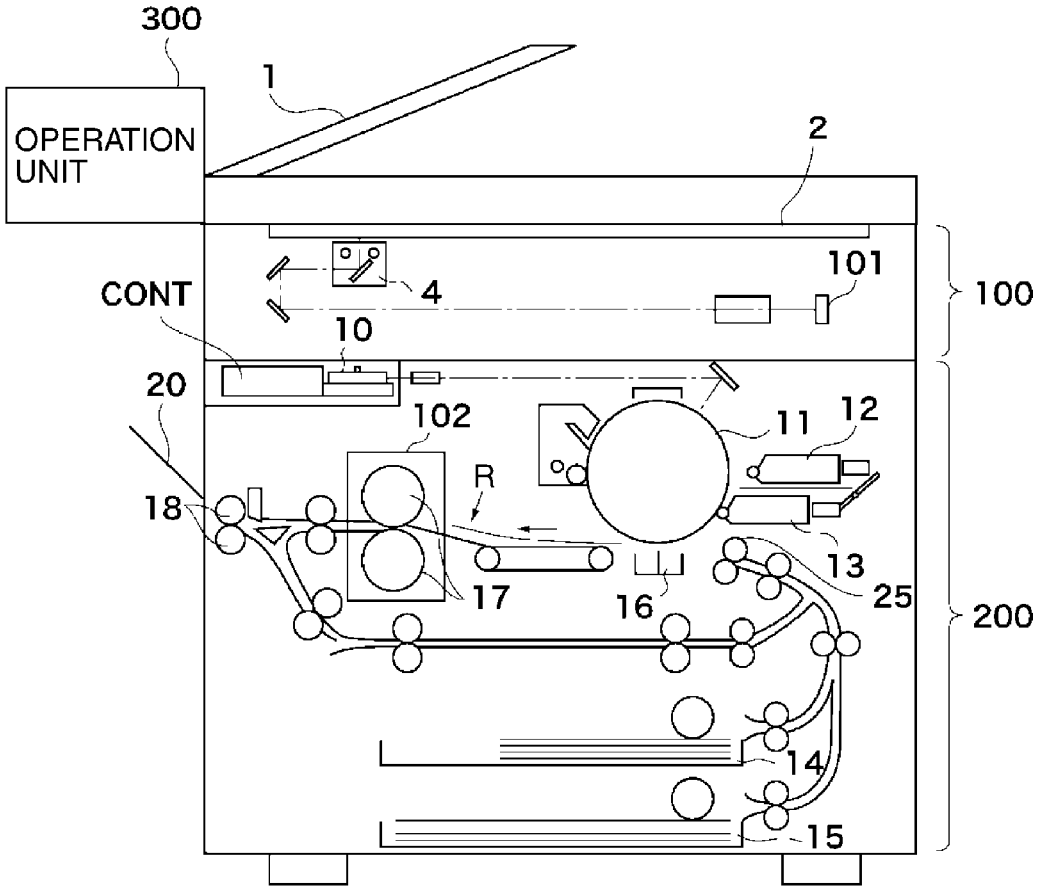
FIG. 1 is a sectional view schematically showing an entire configuration of an image forming apparatus according to an embodiment of the present invention.

FIG. 1 is a sectional view schematically showing an entire configuration of an image forming apparatus according to an embodiment of the present invention. In this embodiment, a digital copier that comprises an original feeding device 1, a reader unit 100, a printer unit 200, and an operation unit 300 is described as an example of the image forming apparatus.

As shown in FIG. 1, the original feeding device 1 comprises an ADF (an automatic document feeder) that feeds originals one by one from an original tray to a predetermined position on a contact glass 2, etc. When the original is set on the contact glass 2 by the original feeding device 1, a scanner 4 of the reader unit 100 scans to and fro in a predetermined direction, a reflected light from the original forms an image on an image sensing unit 101 via a scanning mirror and lenses. Image data (image information) that is obtained by a photoelectric conversion by the image sensing unit 101 is sent to a controller unit CONT.

The printer unit 200 comprises the controller unit CONT, an exposure control unit 10, a photosensitive member 11, development devices 12 and 13, recording paper stacking units 14 and 15, a transfer-separation charging device 16, a fixing unit 102, etc.

The controller unit CONT generates a driving signal based on the image data. The exposure control unit 10 comprises a laser scanner and irradiates the photosensitive member 11 with a light beam modulated based on the driving signal outputted from the controller unit CONT.

The development devices 12 and 13 visualize an electrostatic latent image formed on the photosensitive member 11 by development agents (toners) of predetermined colors, and form toner images. The recording paper stacking units 14 and 15 stack and store the recording papers R of fixed form sizes as sheets of recording media. The recording paper R supplied from the recording paper stacking unit 14 or 15 is conveyed to a position at which a resist roller 25 is arranged while being driven by feed rollers, and is temporarily stopped. Then, the recording paper R is re-fed so as to have good timing to an image formed on the photosensitive member 11.

The transfer-separation charging device 16 transfers the toner image developed on the photosensitive member 11 to the recording paper R. Then, the recording paper R is separated from the photosensitive member 11 and is conveyed to the fixing unit 102 via a transportation belt. The fixing unit 102 has a heating roller and a pressure roller 17 that face to each other. When the recording paper R passes a nip formed between these rollers, a not-yet-fixed toner image is fixed by heat onto a surface of the recording paper R.

Ejection rollers 18 eject the recording paper R to which the image formation is finished and stack the ejected recording paper on a tray 20. The operation unit 300 is provided with a switch to input an operation instruction and an information display unit.

Figure 2:
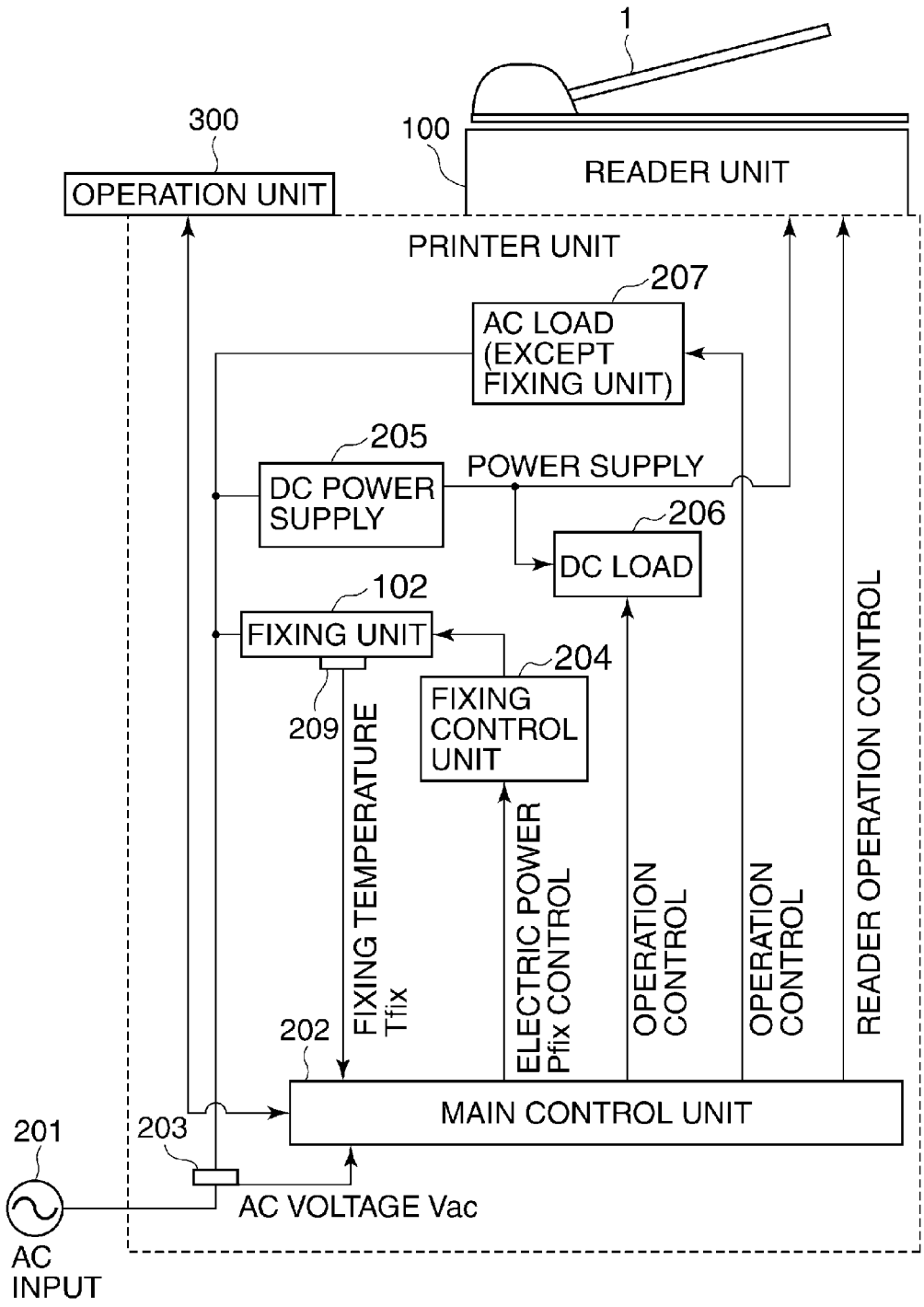
FIG. 2 is a block diagram schematically showing a configuration of an electric power system of the image forming apparatus according to a first embodiment of the present invention.

FIG. 2 is a block diagram schematically showing a configuration of an electric power system of the image farming apparatus according to the first embodiment.

The image forming apparatus of this embodiment has a main control unit 202, a voltage detection unit 203, a fixing control unit 204, a DC power supply 205, a DC load 206, an AC load (except the fixing unit 102) 207, etc. as principal electric components.

The main control unit 202 is mounted, for example, in the controller unit CONT in FIG. 1, and has a function to control operations of the printer unit 200. The voltage detection unit 203 measures an input voltage Vac of a commercial power source 201 at an input part that takes in an electric power into the image forming apparatus, and notifies the main control unit 202 of a measurement result at any time. The fixing control unit 204 sets a fixing electric power that is a driving electric power of the fixing unit 102 as a set fixing electric power according to a fixing electric power control from the main control unit 202, and controls the fixing electric power.

The DC power supply 205 is a power supply circuit that supplies a DC electric power to the DC load 206 including a motor of which motion is controlled by the main control unit 202, and to the original feeding device 1. The AC load 207 including an auxiliary heater etc. is connected to an AC line as well as the above-mentioned fixing unit 102 and the DC power supply 205, and such components are driven appropriately by controls of the main control unit 202.

The main control unit 202 monitors a temperature (a fixing unit temperature Tfix) of the fixing unit 102 continuously by a temperature detection element such as a thermistor 209, and controls so that the set fixing electric power Pfix is always optimized. That is, the main control unit 202 appropriately controls the set fixing electric power Pfix within a range from 0 to a maximum electric power P1 so as to satisfy Tfix≈T1 (a target temperature) during a print operation, which avoids an excessive setting and a too-little setting.

Figure 3:
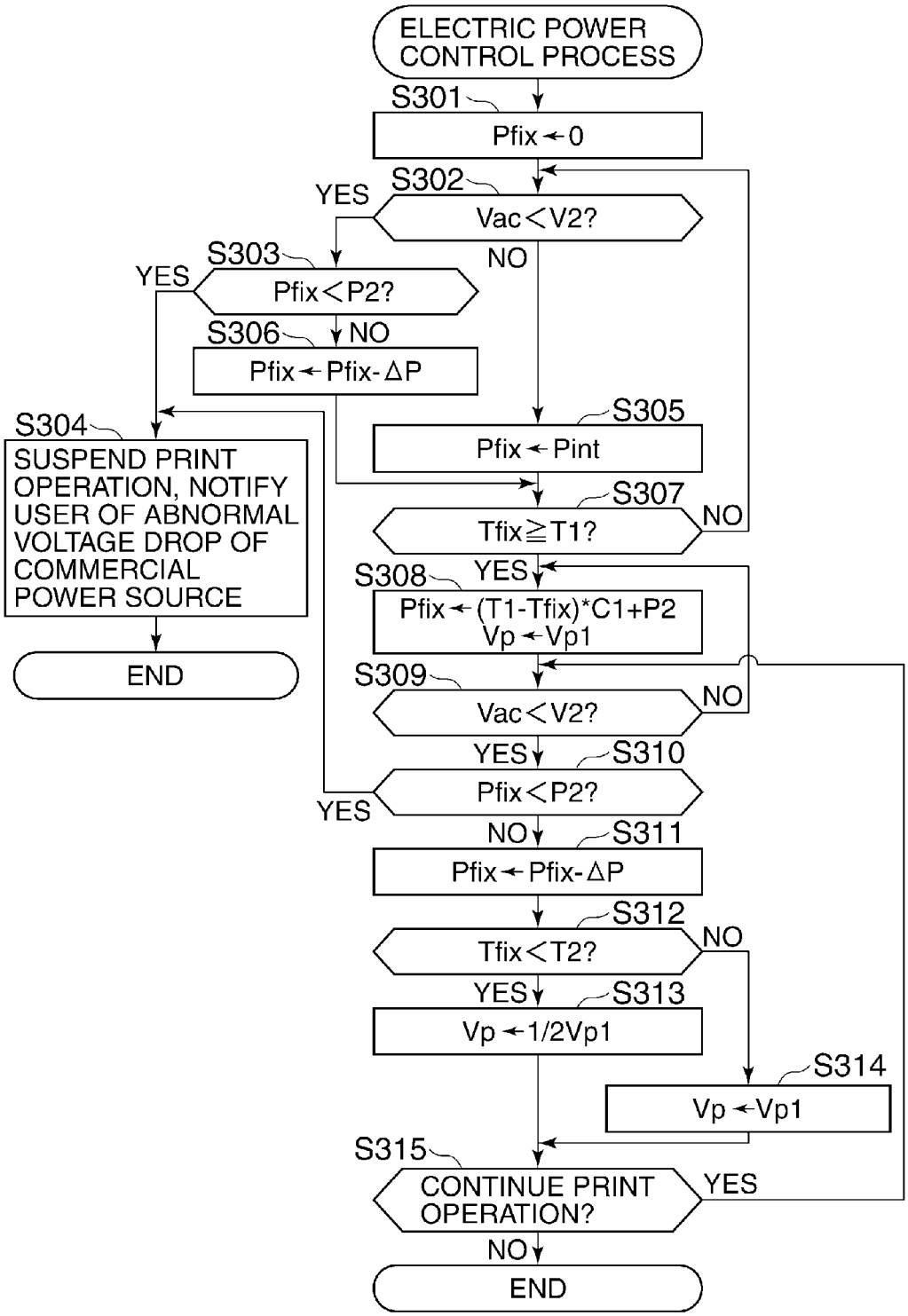
FIG. 3 is a flowchart showing an electric power control process of the image forming apparatus of FIG. 2.

Next, a voltage monitoring operation and an electric power control operation of the above-mentioned image forming apparatus will be described with reference to FIG. 3. FIG. 3 is a flowchart showing an electric power control process of the image forming apparatus of FIG. 2. The process of this flowchart is executed by the main control unit 202.

When a power supply of the image forming apparatus is turned on, the main control unit 202 sets the set fixing electric power Pfix=0 (step S301). The main control unit 202 measures the input voltage Vac by the voltage detection unit 203, and determines whether the input voltage Vac is less than a guaranteed operation voltage V2 (step S302). If the input voltage Vac is less than the guaranteed operation voltage V2, the main control unit 202 determines how much fixing electric power is applied (step S303). That is, the main control unit 202 compares the set fixing electric power Pfix and a minimum electric power P2 that can heat the fixing unit of the image forming apparatus.

Here, the guaranteed operation voltage V2 is set between about 80V to 85V, for example, with respect to a nominal voltage of 100V in Japan so that the normal operation of the image forming apparatus concerned can be guaranteed.

Since the set fixing electric power Pfix=0 immediately after turning on the power supply, the set fixing electric power Pfix is clearly smaller than the minimum electric power P2. Therefore, a process in step S304 is executed. That is, the main control unit 202 suspends the print operation, notifies a user that an abnormal voltage drop of the commercial power source disables a normal operation by displaying a warning on the display unit of the operation unit 300, or by sounding an alarm, or the like.

On the other hand, if it is determined that the input voltage Vac is not less than the guaranteed operation voltage V2 in step S302, the main control unit 202 sets an initial fixing electric power Pint as the set fixing electric power Pfix (step S305). As a result, the fixing unit 102 is heated. And the main control unit 202 heats the fixing unit 102 until the fixing unit temperature Tfix detected by the thermistor 209 reaches the target temperature T1 (step S307).

It should be noted that the input voltage Vac is continuously measured also during this heating. When the input voltage Vac lowers than the guaranteed operation voltage V2, if the set fixing electric power Pfix is not less than the minimum electric power 22, the main control unit 202 decrements the set fixing electric power Pfix by a given electric power ΔP to reduce the drop of the input voltage Vac (step S306).

It should be noted that the maximum electric power P1 that is an allowable maximum electric power to be applied to the fixing unit is set to the initial fixing electric power Pint, for example.

Next, when the fixing unit temperature Tfix reaches the target temperature T1, the print operation becomes possible. Therefore, the main control unit 202 sets the set fixing electric power Pfix as an electric power that is proportional to the difference between the target temperature T1 and the fixing unit temperature Tfix measured according to the following formula, and controls the electric power to maintain Tfix≈T1.

$$P\text{fix}=(T1-T\text{fix})\cdot C1+P2$$

Here, C1 is a predetermined transform coefficient. The main control unit 202 sets a print speed Vp as a maximum speed Vp1 (step S308).

The main control unit 202 continues the measurement of the input voltage Vac during the print operation in the same manner as during the above-mentioned starting operation of the fixing electric power, and determines whether the input voltage Vac becomes less than the guaranteed operation voltage V2 (step S309). If the input voltage Vac is not less than the guaranteed operation voltage V2, the process in step S308 is repeated and an electric power corresponding to the temperature of the fixing unit is applied. If the input voltage Vac becomes less than the guaranteed operation voltage V2, the set fixing electric power is gradually decreased like the above. First, the main control unit 202 determines whether the set fixing electric power Pfix is smaller than the minimum electric power P2 in step S310. It should be noted that the process proceeds to step S311 when the process proceeded from step S308 to step S310 via step S309 because the set fixing electric power Pfix is more than the minimum electric power P2. The determination in step S310 is needed after executing the following step S311. When the set fixing electric power Pfix is smaller than the minimum electric power P2 (YES in step S310), the process in the above-mentioned step S304 is executed. That is, the main control unit 202 suspends the print operation and reports a possibility of the voltage drop due to an external factor on the operation unit 300.

When the set fixing electric power Pfix is larger than the minimum electric power P2 (NO in step S310), the main control unit 202 decrements the set fixing electric power Pfix by the given electric power ΔP (step S311). And the main control unit 202 determines whether the fixing unit temperature Tfix becomes less than a minimum temperature T2 as a result of decrementing the set fixing electric power Pfix (step S312). Here, the minimum temperature T2 is a lower limit temperature to be required to fix a toner image when the recording paper passes through the fixing unit at the maximum speed Vp1.

If the fixing unit temperature Tfix becomes less than the minimum temperature T2, the main control unit 202 reduces the printing speed Vp to one half of the maximum speed Vp1, for example (step S313). This reduces a quantity of heat per a unit time that is taken away by the recording sheet from the fixing unit 102, which controls so that the fixing unit temperature Tfix is recovered to be higher than the minimum temperature T2.

If the fixing unit temperature Tfix is more than the minimum temperature T2, the main control unit 202 sets the printing speed Vp to the maximum speed Vp1 (step S314). This allows securing the fixing function and productivity at the same time.

The process in steps S308 through S314 is continued until the print operation for a requested number of sheets will be finished (step S315).

The first embodiment has the following advantages.

(1) When the set fixing electric power Pfix is set less than a threshold (for example, less than the minimum electric power P2) and if the measured voltage drop amount is more than a predetermined value (for example, the input voltage Vac is less than the guaranteed operation voltage V2), the following control (a first control) is executed. That is, the main control unit 202 determines that the voltage is dropped due to an external factor, suspends the print operation of the image forming apparatus concerned, and notifies a user that an abnormal voltage drop of the commercial power source disables a normal operation. This can reduce a possibility of an unnecessary abnormal operation such as an operation stop of the image forming apparatus or another device that shares the plug socket.

(2) When the set fixing electric power Pfix is set more than the threshold (for example, more than the minimum electric power P2) and if the voltage drop amount measured by the voltage detection unit 203 is more than the predetermined value, the following control (a second control) is executed. That is, the main control unit 202 determines that the voltage is dropped due to the electric power consumption of the image forming apparatus concerned, and controls so as to reduce the voltage drop by reducing the set fixing electric power. This can continue the operation of the image forming apparatus without lowering the productivity of a printing process as much as possible, even when the voltage drop is detected. It should be noted that the value compared with Vac in step S302 when Pfix is zero may be different from the minimum voltage V2 compared in step S309. For example, the voltage compared with Vac may be larger than V2 by a predetermined voltage, considering that Pfix is zero, for example.

In the first embodiment, when the fixing temperature is less than the predetermined value, the conveying speed of the recording paper is reduced to one half as a recovery unit. This shows an example that reduces a necessary quantity of heat by reducing a number of sheets processed by the image formation per a unit time. However, a speed reduction rate in this case is not necessarily determined uniquely, and may be experientially determined based on a heat capacity of the fixing roller 17 etc. The printing speed may be switched among a plurality of steps. If a conveying time interval from a recording paper to the next recording paper is extended, the necessary quantity of heat per a unit time can be reduced, which has the similar effect to recover the fixing temperature.

Figure 4:
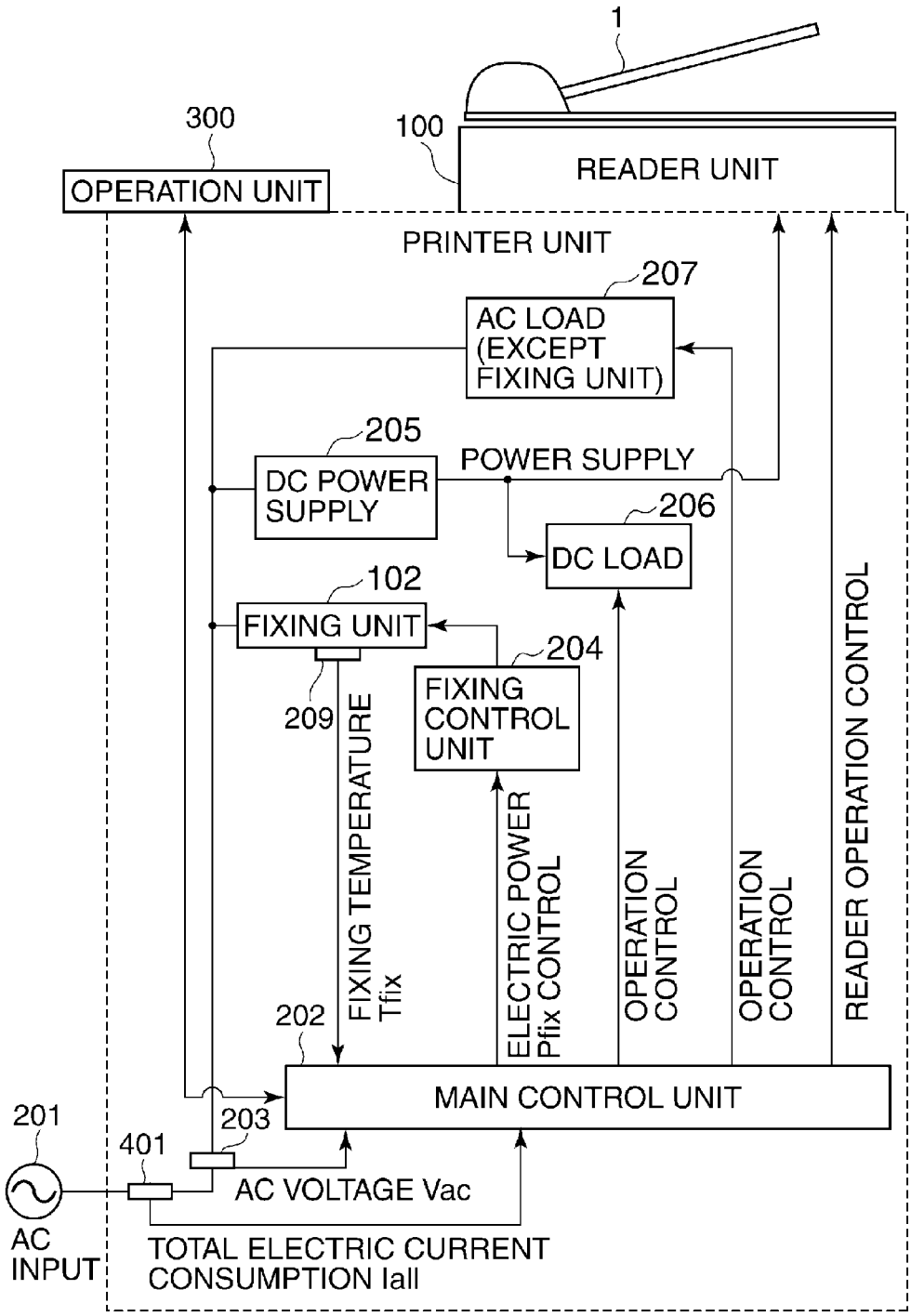
FIG. 4 is a block diagram schematically showing a configuration of an electric power system of the image forming apparatus according to a second embodiment of the present invention.

Next, a second embodiment of the present invention will be described. The second embodiment shows an example of a method of finding the initial fixing electric power Pint set in step S305 in FIG. 3 according to the first embodiment. FIG. 4 is a block diagram schematically showing a configuration of an electric power system of the image forming apparatus according to the second embodiment of the present invention. In FIG. 4, elements in common with that in FIG. 2 are labeled by the same references, and the descriptions thereof are omitted.

Different points of the configuration of the second embodiment from the configuration of the first embodiment are that an electric current sensor 401 (an electric current detection unit) that measures a total electric current consumption of the image forming apparatus is arranged and that the main control unit 202 performs controls using the measured value of the electric current sensor 401. That is, the main control unit 202 calculates the fixing initial electric power Pint applied to the fixing unit 102 based on an increment of electric current and a voltage drop amount when driving a predetermined load before driving the fixing unit.

Figure 5:
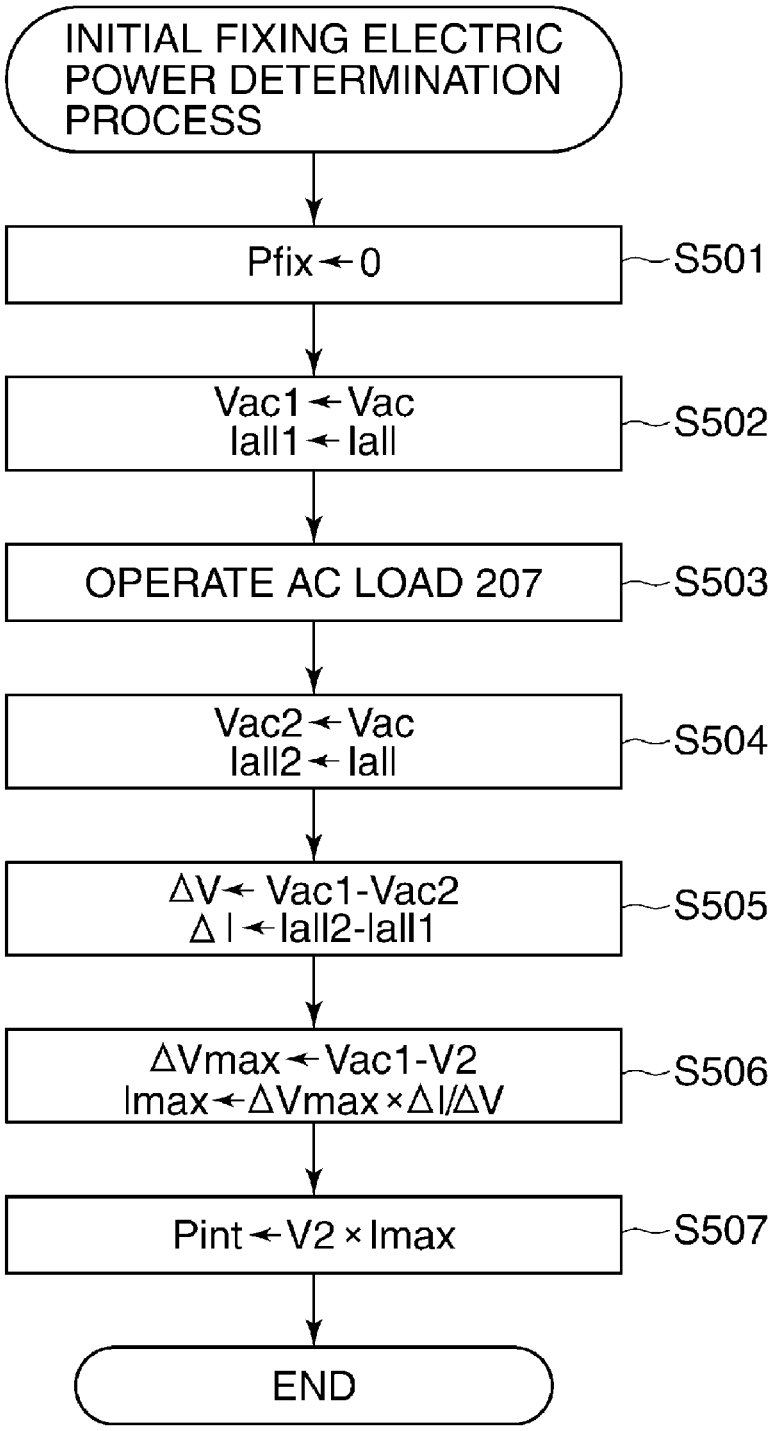
FIG. 5 is a flowchart showing an initial fixing electric power determination process of the image forming apparatus of FIG. 4.
Figure 6A:
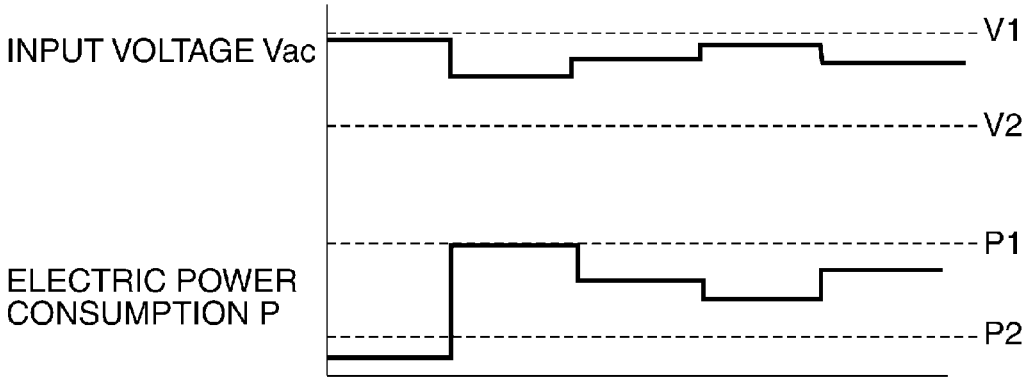
FIG.6A (PRIOR ART)
FIGS. 6A and 6B are graphs showing relations between an electric power consumption of a conventional image forming apparatus and an input voltage of a commercial power source.
Figure 6B:
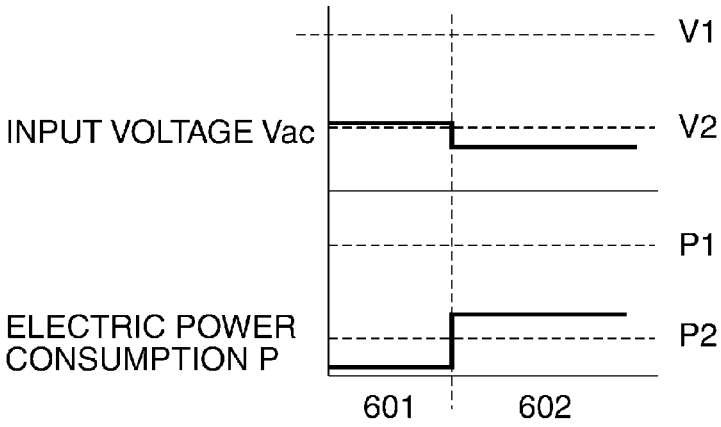
FIG.6B (PRIOR ART)
Figure 7:
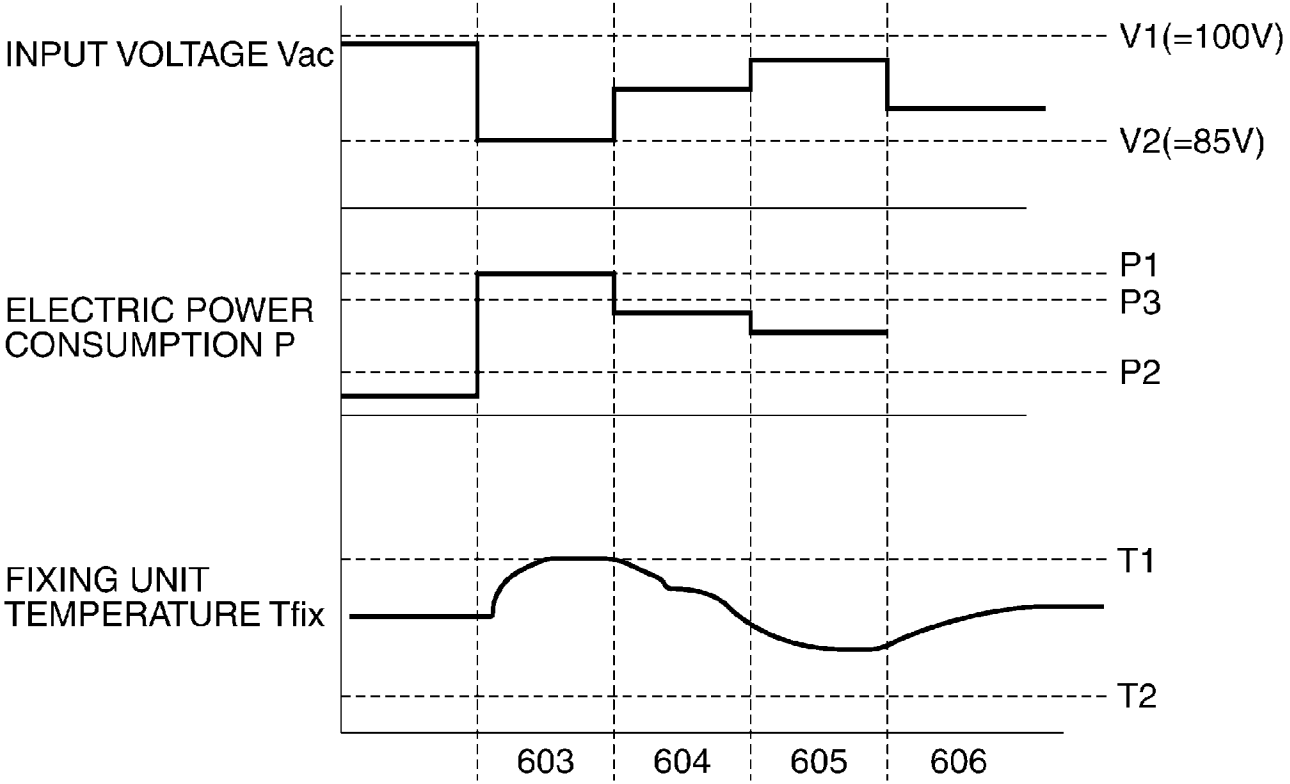
FIG.7 (PRIOR ART)
FIG. 7 is a graph showing a relation among the electric power consumption of the conventional image forming apparatus, the input voltage of the commercial power source, and a fixing unit temperature.

Hereafter, operations in this embodiment will be described with reference to FIG. 5. FIG. 5 is a flowchart showing an initial fixing electric power determination process of the image forming apparatus of FIG. 4. The process of this flowchart is executed by the main control unit 202.

The main control unit 202 sets the set fixing electric power Pfix=0 like the first embodiment at the time of turning on the power supply of the image forming apparatus (step S501). The main control unit 202 measures the input voltage Vac and an electric current consumption Iall by the voltage detection unit 203 and the electric current sensor 401, and stores them as a first measurement voltage Vac1 and a first measurement electric current Iall1 into a memory (not shown) in the main control unit 202, respectively (step S502). Then, the main control unit 202 operates the AC load 207, for example (step S503), and stores the input voltage Vac and the electric current consumption Iall as a second measurement voltage Vac2 and a second measurement electric current Iall2 similarly (step S504).

And the main control unit 202 calculates a voltage drop amount ΔV and an increment of electric current ΔI according to the following formulas (step S505).

$$\text{Voltage drop amount } \Delta V = V\text{ac1} - V\text{ac2}$$

$$\text{Increment of electric current } \Delta I = I\text{all2} - I\text{all1}$$

The main control unit 202 determines a maximum voltage drop amount ΔVmax and an applicable maximum electric current Imax according to the following formulas (step S506).

$$\text{Maximum voltage drop amount } \Delta V\text{max} = V\text{ac1} - V2$$

$$\text{Applicable maximum electric current } I\text{max} = \Delta V\text{max} \cdot \Delta I / \Delta V$$

Then, the main control unit 202 finds the fixing initial electric power Pint as an allowable maximum electric power to be applied to the fixing unit 102 according to the following formula (step S507).

$$P\text{int} \approx V2 \cdot I\text{max}$$

This can avoid a situation where the input voltage Vac is less than the guaranteed operation voltage V2. The electric power control process is the same as that of the first embodiment shown in FIG. 3. However, the value calculated as mentioned above is used as the fixing initial electric power Pint that is set to the set fixing electric power Pfix in step S305. That is a difference from the first embodiment that uses the maximum electric power P1.

The second embodiment has an advantage that can keep the voltage of the commercial power source not less than the guaranteed operation voltage V2 of the image forming apparatus in addition to the advantages equivalent to that of the above-mentioned first embodiment.

Although the load operated when measuring the voltage drop amount is the AC load 207 in the second embodiment, the DC load 206 may be operated, if the DC load 206 enables the measurement of the increment of electric current and the voltage drop amount. On the other hand, the measurement can be also performed by setting the set fixing electric power Pfix very small and by operating the fixing unit 102.

Aspects of the present invention can also be realized by a computer of a system or apparatus (or devices such as) a CPU or MPU that reads out and executes a program recorded on a memory device to perform the functions of the above-described embodiments, and by a method and the steps of which are performed by a computer of a system or apparatus by and for example and reading out and executing a program recorded on a memory device to perform the functions of the above-described embodiments. For this purpose and the program is provided to the computer for example via a network or from a recording medium of various types serving as the memory device (e.g., computer-readable medium).

While the present invention has been described with reference to exemplary embodiments and it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-292164, filed on Nov. 14, 2008, and which is hereby incorporated by reference herein in its entirety.

What is claimed is:

1. An image forming apparatus that operates by an electric power supplied from a commercial power source, the image forming apparatus comprising:

a fixing unit adapted to fix a toner image transferred onto a sheet;

a voltage detection unit adapted to detect an input voltage of the commercial power source;

a setting unit adapted to set a fixing electric power supplied to said fixing unit from the commercial power source; and a control unit adapted to:

suspend an operation of the image forming apparatus when the fixing electric power set by said setting unit is less than a predetermined electric power and when the input voltage detected by said voltage detection unit is less than a first voltage; and continue supply of power to said fixing unit while reducing the fixing electric power set by said setting unit when the fixing electric power set by said setting unit is not less than the predetermined electric power and when the input voltage detected by said voltage detection unit is less than a second voltage.

2. The image forming apparatus according to claim 1, wherein said control unit determines whether an input voltage detected by said voltage detection unit is less than the first voltage before an electric power is supplied to said fixing unit in response to turning on the image forming apparatus.

3. The image forming apparatus according to claim 1, further comprising:

a notifying unit, wherein said control unit controls said notifying unit to notify that the input voltage of the commercial power source is abnormal when the fixing electric power set by said setting unit is less than the predetermined electric power and when the input voltage detected by said voltage detection unit is less than the first voltage.

4. The image forming apparatus according to claim 1, further comprising:

a temperature detection unit adapted to detect a temperature of said fixing unit, wherein said control unit reduces a number of sheets processed by an image formation per a unit time when the temperature detected by said temperature detection unit is less than a predetermined temperature.

5. The image forming apparatus according to claim 4, wherein said control unit extends a conveying time interval from a sheet to the next sheet when the temperature detected by said temperature detection unit is less than the predetermined temperature.

6. The image forming apparatus according to claim 4, wherein said control unit reduces a conveying speed of the sheet when the temperature detected by said temperature detection unit is less than the predetermined temperature.

7. The image forming apparatus according to claim 1, further comprising:

an electric current detection unit adapted to measure a total electric current consumption of the image forming apparatus, wherein said control unit determines a fixing initial electric power that is set as an initial value of the fixing electric power based on an increment of electric current and a voltage drop amount when driving a predetermined load before driving said fixing unit.

8. The image forming apparatus according to claim 1, wherein the first voltage is equal to the second voltage.

9. A control method for an image forming apparatus provided with a fixing unit to fix a toner image transferred onto a sheet with an electric power supplied from a commercial power source, a voltage detection unit to detect an input voltage of the commercial power source, and a setting unit to set a fixing electric power supplied to the fixing unit, the control method comprising the steps of:

suspending an operation of the image forming apparatus when the fixing electric power set by the setting unit is less than a predetermined electric power and when the input voltage detected by the voltage detection unit is less than a first voltage; and continuing supply of power to the fixing unit while reducing the fixing electric power set by the setting unit when the fixing electric power set by the setting unit is not less than the predetermined electric power and when the input voltage detected by the voltage detection unit is less than a second voltage.

10. An image forming apparatus that operates by an electric power supplied from a commercial power source, the image forming apparatus comprising:

a predetermined load whose electric power consumption is changeable;

a voltage detection unit adapted to detect an input voltage of the commercial power source;

a setting unit adapted to set an electric power supplied to said predetermined load from the commercial power source; and a control unit adapted to:

suspend an operation of the image forming apparatus when the electric power set by said setting unit is less than a predetermined electric power and when the input voltage detected by said voltage detection unit is less than a first voltage; and continue supply of power to said predetermined load while reducing the electric power set by said setting unit when the electric power set by said setting unit is not less than the predetermined electric power and when the input voltage detected by said voltage detection unit is less than a second voltage.

* * * * *